United States Patent [19]

Capps

[11] Patent Number: 5,014,985

[45] Date of Patent: May 14, 1991

[54] GOLF QUEUING STATION

[76] Inventor: Alan W. Capps, 7322 Blythwood La., Charlotte, N.C. 28215

[21] Appl. No.: 525,190

[22] Filed: May 17, 1990

Related U.S. Application Data

[63] Continuation-in-part of Ser. No. 443,355, Nov. 30, 1989.

[51] Int. Cl.[5] ..... A63B 47/04; A63B 57/00

[52] U.S. Cl. ..... 273/32 R; 15/21.2; 40/306

[58] Field of Search ..... 273/32 R, 32 B, 32 H; 40/306; 15/21.2; 221/96

[56] References Cited

U.S. PATENT DOCUMENTS

| | | | |
|---|---|---|---|
| D. 233,942 | 12/1974 | Sapier | D34/5 |
| D. 246,808 | 12/1977 | Genova | D21/234 |
| D. 246,809 | 12/1977 | Genova | D21/234 |
| D. 246,810 | 12/1977 | Genova | D21/234 |
| D. 246,864 | 1/1978 | Genova | D21/234 |
| 1,858,758 | 5/1932 | Wolfe | 221/96 |
| 2,834,506 | 5/1958 | Schaefer | 220/908 X |
| 3,478,452 | 11/1969 | Bidwell et al. | 273/32 H X |
| 3,604,592 | 9/1971 | Bacon et al. | 221/96 |
| 3,685,168 | 8/1972 | Reitz | 273/32 H X |
| 3,748,676 | 7/1973 | Warren et al. | 15/21.2 |
| 3,793,756 | 2/1974 | Kay et al. | 40/306 |
| 3,803,738 | 4/1974 | Weiss | 40/306 |
| 3,947,985 | 4/1976 | Skrzypczak | 40/306 X |
| 4,577,778 | 3/1986 | Kim | 220/407 X |
| 4,783,071 | 11/1988 | Tattershall | 273/32 H |

*Primary Examiner*—William H. Grieb

*Attorney, Agent, or Firm*—Ralph H. Dougherty

[57] ABSTRACT

A golf queuing station includes means providing multiple functions useful in the vicinity of a golf course teeing area, enclosed in a generally hollow structure or housing upstanding from a base. A variety of materials may be used for the housing, such as metal, plastic, polymer, wood, and fiber glass, but the preferred material is aluminum. A refuse container is situated within the housing. A variety of information may be displayed inclouding advertising information and information about the golf hole associated with the teeing area of a golf hole on a removable information panel which is held in position by Z-shaped tracks. A fluid containing tank may also be contained within the housing. Hand-held fluid containers, such as cups, are also contained and dispensed from within the housing. The golf queuing station may also include a golf ball washer. The housing includes a storage container for a variety of golfing related materials such as score cards, pencils, and brochures. Foundation posts connected to the unitary device are embedded in pits in the ground and secured by concrete poured within the pits. A concrete mowing strip above grade level surrounding the base of the unitary device may also be provided.

26 Claims, 4 Drawing Sheets

GOLF QUEUING STATION

CROSS REFERENCE TO RELATED APPLICATION

This application is a continuation-in-part application of co-pending application Ser. No. 07/443,355 filed Nov. 30, 1989.

tions of such devices in a unitary manner in order to minimize the impact to the natural surroundings, and also provides a means for displaying a variety of information.

Applicant is aware of the following U.S. Pat. Nos. concerning devices that may be used in the vicinity of golf courses:

| U.S. Pat. No. | Issue Date | Inventor | Title |
|---|---|---|---|
| 2,834,506 | May 13, 1958 | Schaefer | TOWEL DISPENSER AND WASTE RECEPTACLE UNIT, AND MOUNTING BRACKET THEREFOR |
| 3,478,452 | Nov. 11, 1969 | Bidwell et al. | VISUAL AID FOR GOLF |
| D233,942 | Dec. 17, 1974 | Sapier | COMBINED GOLF TEE INDICATOR, BALL WASHER, WASTE RECEPTACLE AND SHOE SCRAPER |
| D246,808 | Dec. 27, 1977 | Genova | COMBINED FAIRWAY MAP, YARD MARKER AND BALL WASHER FOR A GOLF COURSE |
| D246,809 | Dec. 27, 1977 | Genova | COMBINED FAIRWAY MAP, YARD MARKER, BALL WASHER AND REFUSE RECEIVER AND BENCH FOR A GOLF COURSE |
| D246,810 | Dec. 27, 1977 | Genova | COMBINED FAIRWAY MAP, YARD MARKER, REFUSE RECEIVER, BENCH AND BALL WASHER FOR A GOLF COURSE |
| D246,864 | Jan. 3, 1978 | Genova | COMBINED FAIRWAY MAP REFUSE RECEIVER AND YARD MARKER FOR A GOLF COURSE |
| 4,577,778 | March 25, 1986 | Kim | REFUSE RECEPTACLE |
| 4,783,071 | Nov. 8, 1988 | Tattershall | GOLF COURSE PIN DISTANCE DETERMINATION DEVICE |

BACKGROUND OF THE INVENTION

1. Field of the Invention

The present invention generally relates to devices used in the vicinity of a golf course and, more particularly, relates to a device for, among other things, displaying information, storing various golfing related materials, receiving and containing refuse, washing golf balls, and/or dispensing water.

2. Description of Related Art

Golfing is one of the world's favorite pastimes. Reasons for its popularity in the United States, Japan, and Great Britain, among other countries, include the skill involved and the opportunity for relaxation, but certainly include the unique combination of sport and nature. Around the world, thousands of golf courses provide an opportunity to play golf in incredibly scenic surroundings.

The present invention is directed towards preserving that scenic environment by providing a unitary device for containing a variety of golfing-related devices customarily found in the vicinity of the teeing area of a golf course hole. Devices typically found in or around teeing areas include golf ball washers, trash cans, water fountains, etc. The present invention includes the func- Schaefer teaches a towel dispenser and waste receptacle unit, and more particularly, an adapter mounting bracket for mounting a towel dispenser kit on a waste receptacle.

Bidwell et al. teaches a tamper-proof visual indication device for a golf course to be located at each tee comprising an enclosed housing containing a three-dimensional representation of the particular golf hole and a changeable yardage marker.

Sapier, Genova ('808), ('809), ('810), and ('864) are all design patents disclosing combination devices related to golf, such devices being attached to a structure, but not within a unitary device.

Kim teaches a refuse receptacle, and more particularly a refuse receptacle provided with a refuse collecting bag.

Tattershall teaches golf course distance determination devices and more specifically, such devices employing a scaled map or schematic diagram of one or more holes of a particular golf course in combination with indicia from which true ground distance may be calculated.

Each of the patents discussed above relates generally to a device that may be used in the vicinity of a golf course, but differ both in structure and operation from the present invention.

Applicant is unaware of any prior art that accomplishes the objects of the present invention. Consequently, a need exists for a device for, among other things, displaying information, storing various golfing related materials, containing refuse, washing golf balls, and/or dispensing water.

SUMMARY OF THE INVENTION

The present invention is an innovative golf queuing station, which overcomes the problems and satisfies the needs considered above.

The invented golf queuing station provides a plurality of functions used in the vicinity of a golf course teeing area and comprises a unitary device incorporating means for performing such functions, adapted to be permanently fixed or secured near the tee. The queuing station includes a housing, which is a generally hollow structure. The housing is upstanding from a base. A variety of materials may be used for the housing, such as metal, plastic, polymer, wood, and fiber glass, but the preferred material is aluminum. A refuse container is preferably contained within the housing, and has external access through the housing for depositing of refuse therethrough. A panel on the face of the housing provides a display for a variety of information, including advertising information and information about the golf hole associated with the teeing area of a golf hole. A means for dispensing fluid, typically water, may also be contained within the housing. Hand-held fluid containers, such as cups, also may be contained and dispensed from within the housing. The golf queuing station also includes a means for washing golf balls such as a brush-type golf ball washer. The housing is provided with a rack, segmented storage compartments, or a pocket, preferably protected from the elements, or other receptacle for storing a variety of golfing related materials such as score cards, pencils, and brochures. Foundation posts connected to the unitary device are embedded in pits in the ground and secured by concrete poured within the pits. A concrete mowing strip at or above grade level surrounding the base of the unitary device may also be provided to protect the base from damage by mowing devices.

In summary, the invention encompasses a device for, among other things, displaying information, storing various golfing related materials, containing refuse, washing golf balls, and/or dispensing water, thereby providing a plurality of functions useful to a golfer in the vicinity of a golf course teeing area.

OBJECTS OF THE INVENTION

It is the principal object of the invention to provide a golf queuing station having a variety of golfing related features in a unitary device.

It is another object of the invention to provide a golf queuing station capable of displaying a variety of information to golfers.

Another object of the invention is to provide a golf queuing station which is harmonious with the natural setting of a golf course.

Another object of the invention is to provide a golf queuing station which is easy to manufacture and assemble.

Another object of the invention is to provide a device for collecting refuse associated with playing the sport of golf.

Another object of the invention is to provide a golf queuing station for storing a variety of golfing related materials for dispensing to players.

It is another object of the invention to provide a golf queuing station for dispensing drinkable fluids and dispensing containers for drinking the fluid.

Another object of the invention is to provide a golf queuing station for enabling cleaning of golf balls.

Another object of the invention is to provide a golf queuing station having a table-like surface for placing a variety of objects thereon and for providing a writing space (e.g., to record golf scores).

BRIEF DESCRIPTION OF THE DRAWINGS

The foregoing and other objects will become more readily apparent by referring to the following detailed description and the appended drawings in which.

DESCRIPTION OF THE PREFERRED EMBODIMENTS

Figure 1:
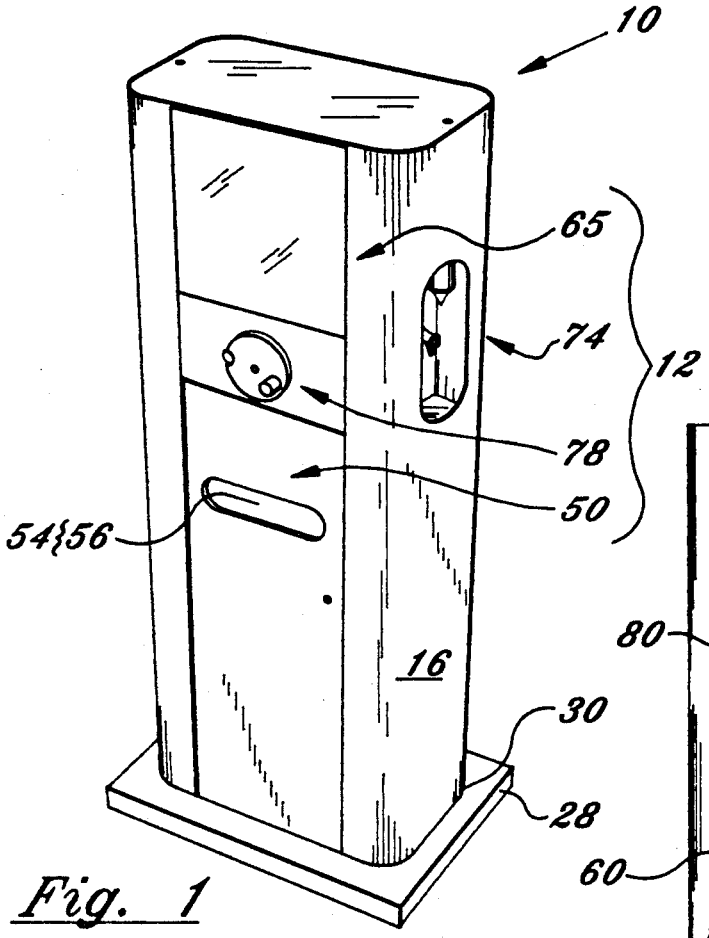
FIG. 1 is a perspective view of the golf queuing station for use in the vicinity of the teeing area of a golf course hole.
Figure 2:
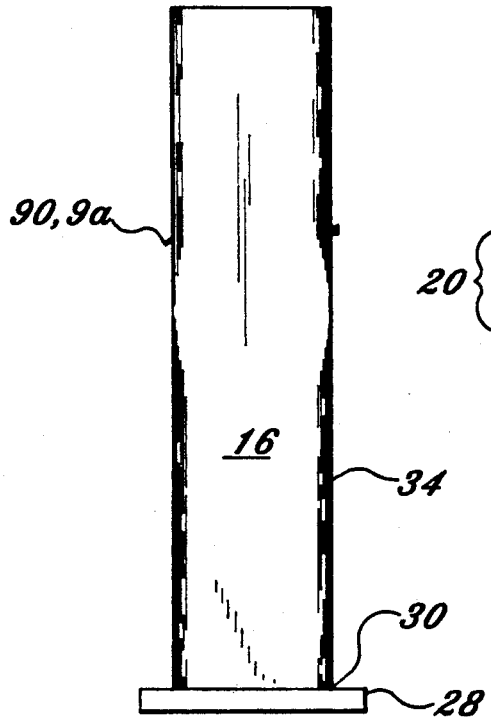
FIG. 2 is a side elevational view of the golf queuing station.

Referring now to the drawings, and more particularly to FIG. 1, a golf queuing station, generally designated 10, comprises the preferred embodiment of the present invention.

Figures 4, 5, 6, 7:
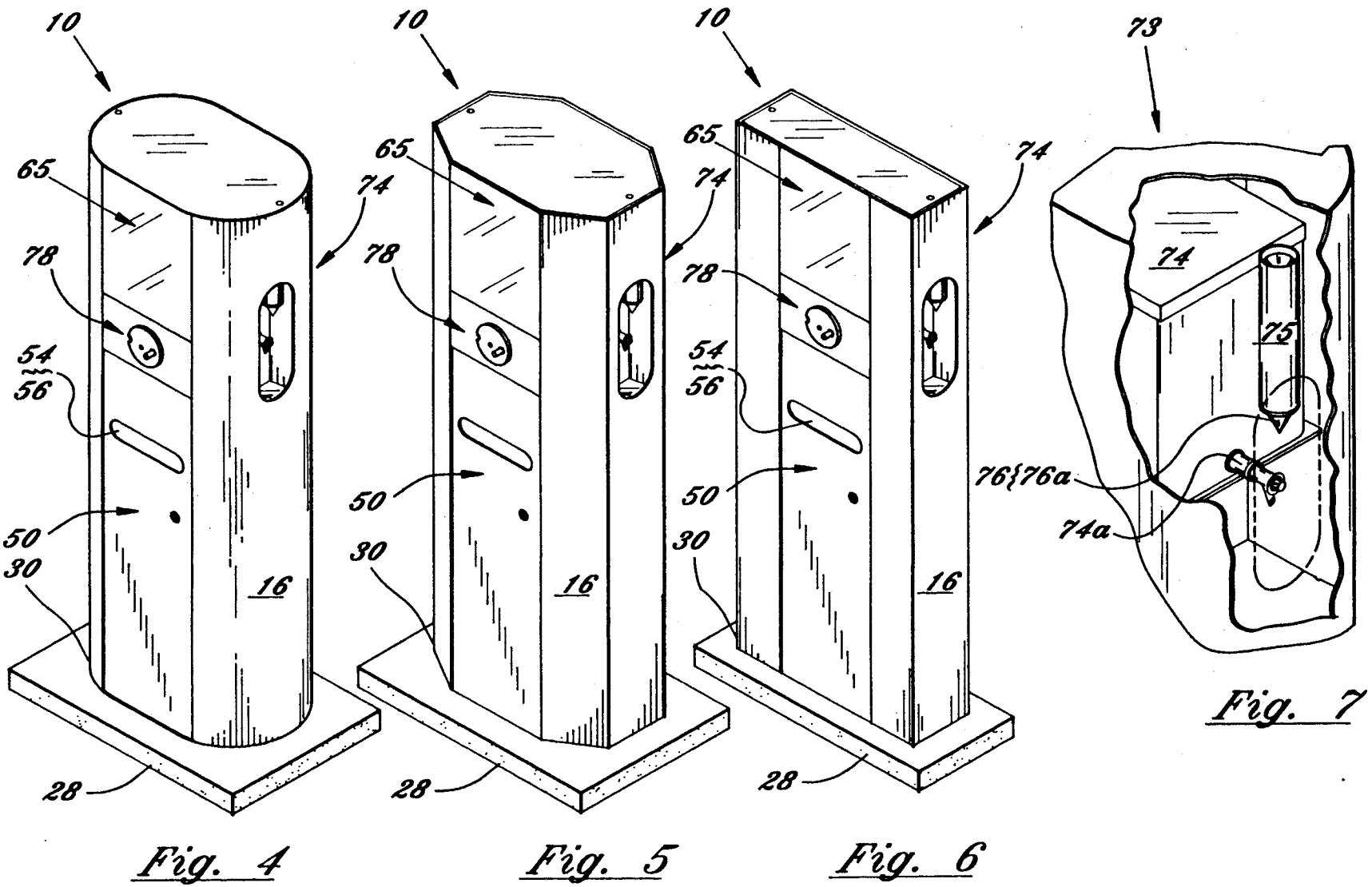
FIG. 4 is a perspective view of an alternative embodiment of the golf queuing station illustrating an ellipsoid exterior shape.
FIG. 5 is a perspective view of an alternative embodiment of the golf queuing station illustrating a polygonal exterior shape.
FIG. 6 is a perspective view of an alternative embodiment of the golf queuing station illustrating a rectangular exterior shape.
FIG. 7 is a break-away perspective view of a portion of the interior of the golf queuing station, illustrating a fluid tank for dispensing fluid and a device for dispensing cups.
Figure 8:
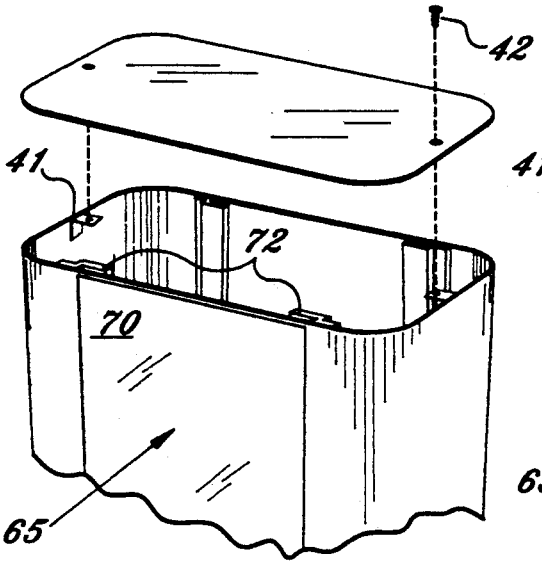
FIG. 8 is an exploded view of the top portion of the golf queuing station illustrating panel means for displaying information, and a top cover for the queuing station secured from the top by screws.
Figure 9:
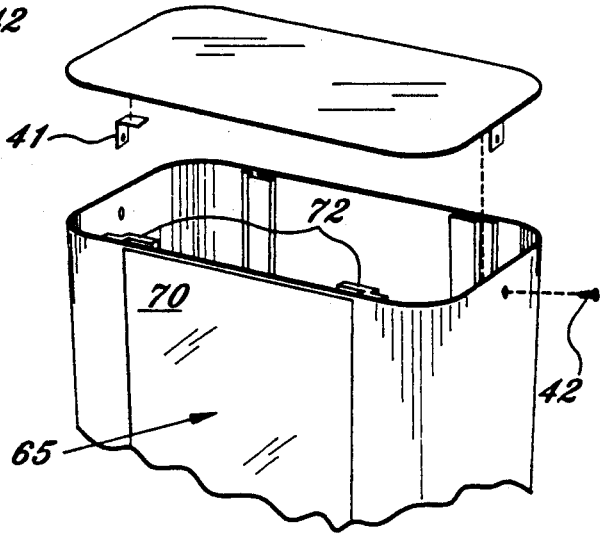
FIG. 9 is an exploded view of an alternative embodiment of the top portion of the golf queuing station illustrating panel means for displaying information, and a top cover for the queuing station secured from the side by screws.
Figure 10:
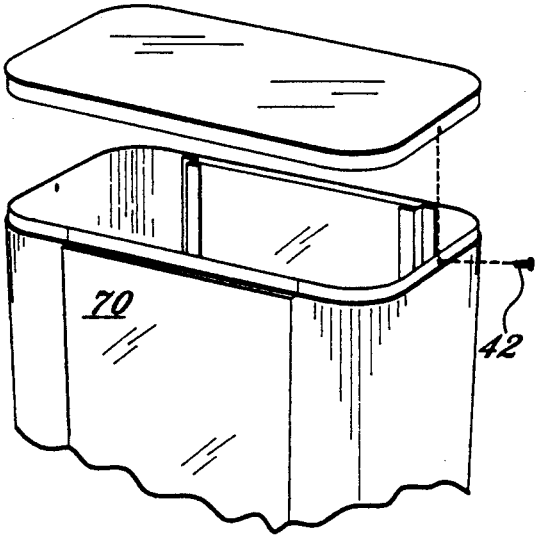
FIG. 10 is an exploded view of an alternative embodiment of a flush mounted top cover for the golf queuing station which extends over the top opening of the station.

The golf queuing station 10 includes devices 12 for performing a plurality of functions used in the vicinity of a golf course teeing area. The golf queuing station 10 includes a base 30, a housing 34 upstanding from the base 30, means 33 in the housing for accessing the interior of the housing 34, and means 65 associated with at least one side of said housing 34 for displaying information thereon. The preferred embodiment encloses the devices 12 in the housing 34 shaped to form a generally hollow structure, which defines a top opening 36 and a bottom opening 38. The top opening 36 may be covered with a removable and replaceable top 37 fixed to the housing 30. The top 37 may be fixed to a flange 41 of housing 34 with screws 42 (FIG. 8), or may be adapted for flush mounting on the housing 34, as shown in FIG. 10. The housing 34, so shaped, stands up from the base 30 and is approximately five feet in height by 2 feet in width by 1 foot in depth. A variety of materials may be used for the housing 34, such as metal **34*b*, plastic 34*c*, polymer 34*d*, wood 34*e*, and fiber glass 34*f*, but the preferred material is aluminum 34*a* having a preferred thickness of approximately 0.125 to 0.090 inches. In addition, the exterior of the housing 34 may take any of a variety of shapes (e.g., round, elliptical, ellipsoidal, or polygonal), as shown in FIGS. 4 through 6. The housing 34** may also have rounded edges.

The aluminum housing 34 is bound to itself by a bonding means 40 such as a Heliarc weld, countersunk screws, mastic adhesive, and/or high bond adhesive tape. The aluminum housing 34 may also be anodized. If the aluminum housing 34 is painted, which is the preferred embodiment, the housing 34 has an acid etched, primed, and polyurethane or enamel painted surface 48. The paint compound 48 includes a catalyst and a hardener.

Figure 3:
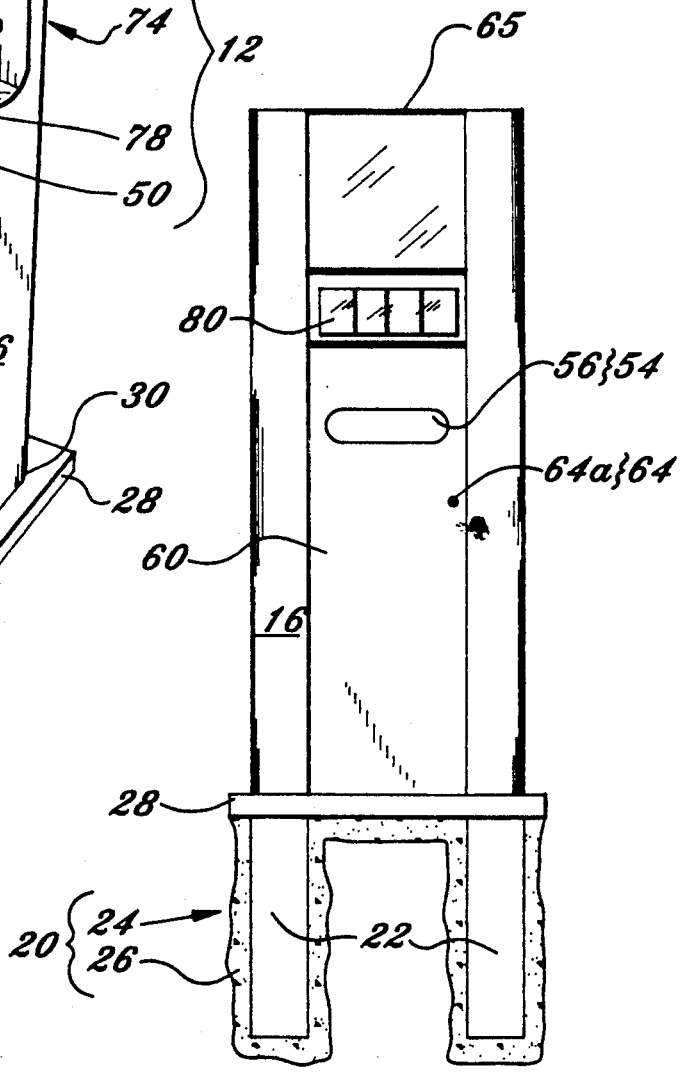
FIG. 3 is a front elevational view of the golf queuing station showing a lockable door access for a refuse container, an auxiliary storage compartment, an information display panel, and foundation posts for securing the station.

In the preferred embodiment, as shown in FIG. 3, means 20 for securing the station 10 include at least one foundation post 22 which connects to the base 20 of the station 10 and extends outwardly from the bottom of the station 10 in a generally downward direction. The foundation posts 22 are embedded in pits 24 in the ground perpendicular to the surface of the earth and secured by concrete 26 poured within the pits 24. Preferably, each foundation post 22 is approximately 24 inches in length by 8 inches in diameter. The pits 24 required for the preferred size posts measure approximately 30 inches in depth by 10 inches in diameter. A concrete mowing strip 28, above grade level, surrounding the base of the station 10 may also be provided.

Figure 11:
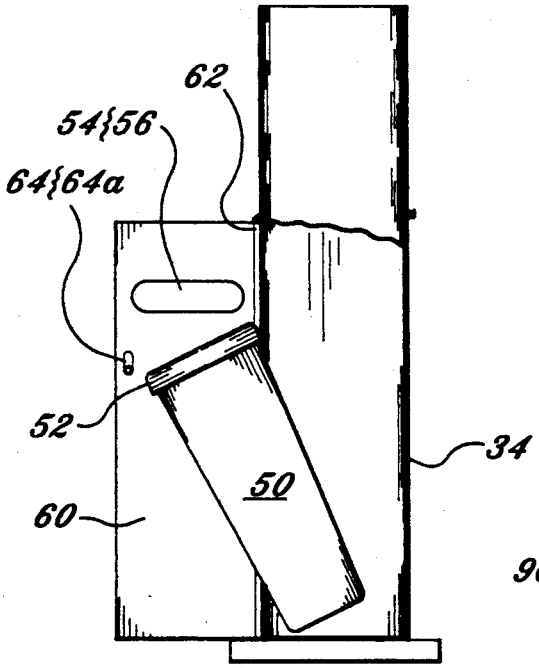
FIG. 11 is a broken side elevational view of the invention illustrating the refuse container.

A refuse container 50 is situated within the housing 34 and is adapted for holding a trash bag 52, as shown in FIG. 11. The means 54 in the housing 34 for depositing refuse into the refuse container 50 from outside the housing 34 includes at least one opening 56 large enough to receive beverage cans and golfball cartons, situated in the housing above the elevation of the top of the refuse container 50. Thus, the refuse container 50 receives refuse upon deposit of into the opening 56. The means 58 for inserting and removing the refuse container includes an access door 60 integral with the housing 34 having associated hinge means 62 for permitting the access door 60 to pivot outwardly. The access door 60 has laching means 64 for latching the access door 60 to the housing 34, the preferred type being a keyless cam lock **64*a*. The refuse container 50 is adapted for tilting outwardly upon opening the access door 60**.

Figure 14:
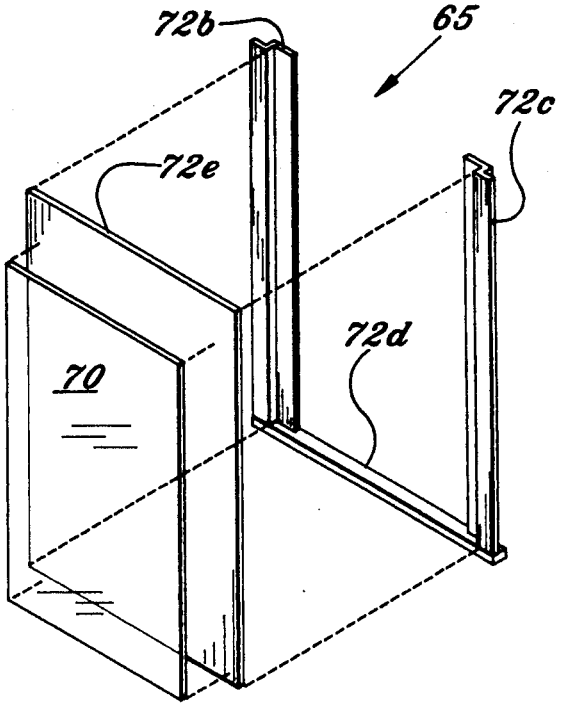
FIG. 14 is an exploded view of the slide-in retainer system.
Figure 15:
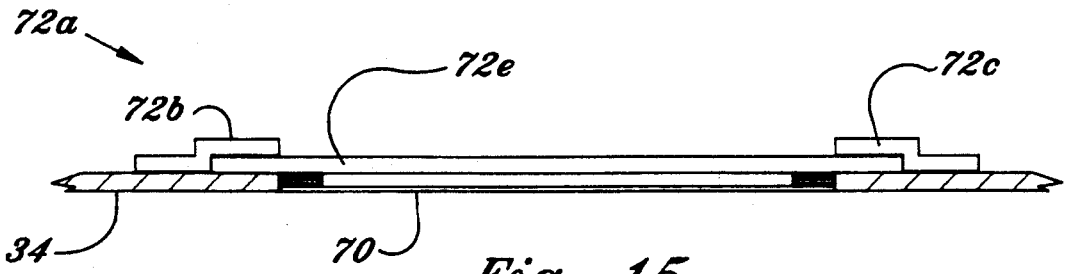
FIG. 15 is a sectional view of the slide-in retainer system, taken along line 15—15, in FIG. 13.
Figure 16:
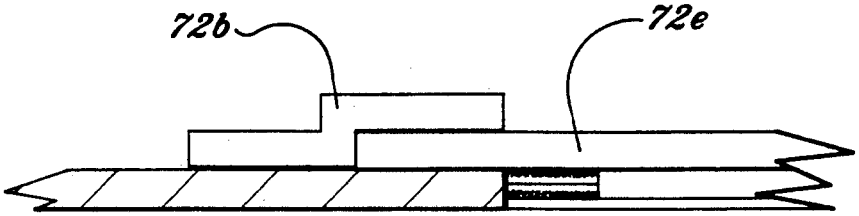
FIG. 16 is a an enlarged view of a portion of FIG. 15.

A key aspect of the invention is the means 65 for displaying information. A variety of information may be displayed including advertising information **66*a* and golf hole information 66*b*, including tee-to-green distance, and fairway, green and hazard information associated with the golf hole, generally in pictorial form. As shown in FIG. 14, means 65 for displaying information includes information media 68 containing information, clear acrylic panels 70 for fronting the information media 68 and protecting the media from the environment, and means 72 for attaching the information media and clear acrylic panels to the housing 34. The attaching means 72 includes a "slide in" retainer system 72*a*. The retainer system 72*a* includes two retaining members 72*b*, 72*c*, preferably having a generally "zee" shaped extruded cross section, a stopping member 72*d* for connecting the two retaining members, and a backing plate 72*e*. The two retaining members 72*b*, 72*c* are joined to the stopping member 72*d* to form a generally "U"-shaped structure and mounted to the interior of the housing 34. The retaining members 72*b*, 72*c* are perpindicular to the base 30, extend to the edge of the top opening 36, and define tracks or channels 72*f* for insertion of the backing plate 72*e* therein. The mounted panel 70 and backing plate 72*e* circumscribe an opening 39 defined by the housing 34. A clear acrylic panel 70, mounted to a backing plate 72*e*, is adapted for insertion into the opening 39 and retention in the retainer system 72*a*. Thus, the interior of the housing 34 has mounted thereon a pair of horizontally opposed vertical tracks 72*f* for receiving a panel 70 and/or information media 68**.

A fluid tank 74 for dispensing fluid, typically water, may also be contained within the housing 34, and have an externally accessible spigot **74*a*. Hand-held fluid containers 76, such as cups 76*a*, are also contained and dispensed from within the housing 34. The golf queuing station 10 also includes a means 78 for washing golf balls such as a golf ball washer 78*a***.

Figure 12:
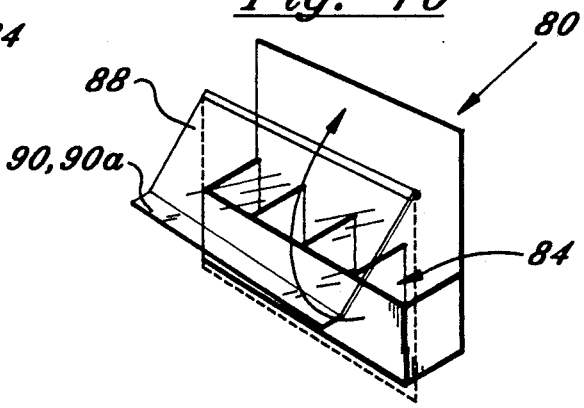
FIG. 12 is an isolated perspective view of the means for storing a variety of golfing related materials such as score cards, pencils, and brochures.
Figure 13:
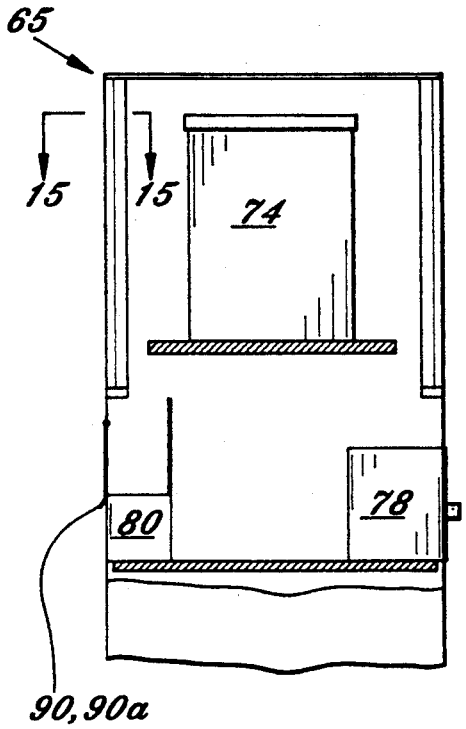
FIG. 13 is a broken side elevational view of the invention illustrating the upper portion of the golf queuing station.

The housing 34 includes means 80 for storing a variety of golfing related materials such as score cards **82*a*, pencils 82*b*, and brochures 82*c*, as shown in FIG. 12. At least one segmented compartment 84 is recessed within the body of the housing 34, supported by a welded angle support 86. A clear acrylic hinged storage door 88 provides access to the storage area and has a handle 90 that is preferably a heat bent section of the storage door 88 bent outwardly at the bottom for providing a tactile surface and for providing a "rain lip" 90*a*** to prevent water from entering the storage area.

SUMMARY OF THE ACHIEVEMENTS OF THE OBJECTS OF THE INVENTION

From the foregoing, it is readily apparent that I have invented a device for containing a variety of golfing related devices into a unitary device, displaying a variety of information to golfers, collecting refuse associated with playing the sport of golf, storing a variety of golfing related materials, dispensing drinkable fluids and dispensing containers for drinking the fluid, cleaning of golf balls, and that will serve as a table-like structure for placing a variety of objects thereon and for providing a writing space (e.g., to record golf scores), which is easy and inexpensive to manufacture and assemble.

It is to be understood that the foregoing description and specific embodiments are merely illustrative of the best mode of the invention and the principles thereof, and that various modifications and additions may be made to the device by those skilled in the art, without departing from the spirit and scope of this invention, which is therefore understood to be limited only by the scope of the appended claims.

I claim:

1. A golf queuing station for use in the vicinity of a golf course teeing area, comprising:
   (a) a base;
   (b) a housing upstanding from said base, incorporating therein a set of golfing convenience devices, including,
      (i) a refuse container positioned within said housing;
      (ii) fluid dispensing means and fluid container dispensing means positioned within said housing;
      (iii) golf ball washing means positioned within said housing; and
      (iv) means positioned within said housing for storing materials;
   (c) means in said housing for accessing the interior of said housing and said golfing convenience devices; and
   (d) display means associated with at least one side of said housing for displaying information thereon.

2. The golf queuing station according to claim 1, wherein said information displaying means is removable from and replaceable in said housing.

3. The golf queuing station according to claim 1, wherein said housing is provided with a removable top fixed thereto.

4. The golf queuing station according to claim 1, wherein the cross-sectional shape of said housing is selected from the group consisting of circle, ellipse, ellipsoid, polygon, and round cornered polygon.

5. The golf queuing station according to claim 1, wherein said housing material is selected from the group consisting of metal, plastic, polymer, wood, and fiber glass.

6. The golf queuing station according to claim 5, wherein said housing material is aluminum.

7. The golf queuing station according to claim 6, wherein said aluminum housing is anodized.

8. The golf queuing station according to claim 6, wherein said aluminum housing has an acid etched, primed, and enamel painted surface, said enamel paint including a catalyst and hardener.

9. The golf queuing station according to claim 1, wherein said housing includes
   means for inserting and removing said refuse container into and out of said housing.

10. The golf queuing station according to claim 9, wherein said inserting and removing means includes an access door integral with said housing having associated hinge means for permitting said access door to pivot outwardly from said housing.

11. The golf queuing station according to claim 10, wherein said access door is provided with latching means for latching said access door to said housing.

12. The golf queuing station according to claim 11, wherein said latching means is a keyless cam lock.

13. The golf queuing station according to claim 9, wherein said inserting and removing means includes said refuse container adapted for tilting outwardly from the access door of said housing.

14. The golf queuing station according to claim 1, wherein said refuse container is adapted for holding a trash bag.

15. The golf queuing station according to claim 1, wherein said access means includes at least one opening large enough to receive beverage cans and golfball cartons, said opening situated in said housing above the elevation of the top of said refuse container, whereby said refuse container receives refuse upon deposit of refuse through said opening.

16. The golf queuing station according to claim 1, wherein said information displaying means includes information about the golf hole associated with said teeing area.

17. The golf queuing station according to claim 1, wherein said information displaying means is a clear acrylic panel.

18. The golf queuing station according to claim 17, further comprising said panel fronting information media for protecting said media from the environment.

19. The golf queuing station according to claim 1, wherein said displaying means includes a pair of horizontally opposed vertical tracks mounted to the interior of said housing for receiving and displaying said information media.

20. The golf queuing station according to claim 1, wherein said storage means includes at least one segmented compartment recessed within the body of said housing, held in fixed position by a support, and a clear acrylic hinged storage door having a handle means integral therewith.

21. The golf queuing station according to claim 20, wherein said storage door is provided with a lower heat bent section bent outwardly for providing a tactile surface and for providing a "rain lip" to prevent water from entering said storing means.

22. The golf queuing station according to claim 1, wherein said securing means includes at least one foundation post connected to said base, extending outwardly from the bottom of said base, in a generally downward direction, and embedded in the ground perpendicular to the surface of the earth.

23. The golf queuing station according to claim 22, wherein said foundation post is permanently embedded in the ground.

24. The golf queuing station according to claim 22, wherein said foundation post is embedded in a pit and secured by concrete within said pit.

25. The golf queuing station according to claim 1, wherein said base includes a concrete mowing strip above grade level surrounding the base of said housing.

26. A golf queuing station for use in the vicinity of a golf course teeing area, comprising:
   (a) a base;
   (b) a housing upstanding from said base, having a top edge thereto;
   (c) means in said housing for accessing the interior of said housing; and
   (d) means associated with at least one side of said housing for displaying information thereon, including
      (i) information media containing information;
      (ii) clear acrylic panels for fronting said information media and protecting said media from the environment; and (iii) means for attaching said information media and said clear acrylic panels to said housing, which includes a "slide in" retainer system, including (1) at least one pair of retaining members, each retaining member having a generally "zee" shaped extruded cross section, (2) a stopping member for connecting said retaining members, and (3) a backing plate, said retaining members being joined to said stopping member to form a generally "U"-shaped structure mounted to the interior of said housing such that said "U"-shaped structure frames and partially overlaps a generally "U"-shaped opening defined by said housing, said retaining members being generally perpendicular to said base and extending generally to said top edge of said housing, said retaining members defining channels for insertion of said information media fronted by said clear acrylic panel and backed by said backing plate, whereby, upon advantageous placement of said mounted information media, clear plastic panel, and backing plate into said channels, said information is viewable through said "U"-shaped opening.

* * * * *

UNITED STATES PATENT AND TRADEMARK OFFICE

CERTIFICATE OF CORRECTION

PATENT NO. : 5,014,985

DATED : May 14, 1991

INVENTOR(S) : Alan W. Capps

It is certified that error appears in the above—identified patent and that said Letters Patent is hereby corrected as shown below:

Cover Page:

item [57] Abstract, line 9, change "including" to -- including --

Column 7, line 26, before "means" insert -- access --

Signed and Sealed this

Seventeenth Day of May, 1994

Bruce Lehman

BRUCE LEHMAN

*Commissioner of Patents and Trademarks*

*Attest:*

*Attesting Officer*